US007767873B2

(12) United States Patent
Pekarek et al.

(10) Patent No.: US 7,767,873 B2
(45) Date of Patent: Aug. 3, 2010

(54) METHOD FOR DEHALOGENATION DETOXICATION OF HALOGENATED AROMATIC AND/OR CYCLIC COMPOUNDS

(75) Inventors: Vladimir Pekarek, Praha (CZ); Petr Hapala, Frydland nad Ostravici (CZ); Eva Fiserova, Praha (CZ)

(73) Assignee: Zdravotni Ustav Se Sidlem V Ostrave, Ostrava (CZ)

( * ) Notice: Subject to any disclaimer, the term of this patent is extended or adjusted under 35 U.S.C. 154(b) by 144 days.

(21) Appl. No.: 10/582,649

(22) PCT Filed: Apr. 28, 2004

(86) PCT No.: PCT/CZ2004/000024

§ 371 (c)(1),
(2), (4) Date: Jun. 13, 2006

(87) PCT Pub. No.: WO2004/096371

PCT Pub. Date: Nov. 11, 2004

(65) Prior Publication Data

US 2007/0021639 A1 Jan. 25, 2007

(30) Foreign Application Priority Data

Apr. 30, 2003 (CZ) ..... PV 2003-1220

(51) Int. Cl.
*A62D 3/34* (2007.01)
*A62D 101/22* (2007.01)

(52) U.S. Cl. ..... 588/316; 588/406

(58) Field of Classification Search ..... 588/406, 588/316, 319, 400, 313
See application file for complete search history.

(56) References Cited

U.S. PATENT DOCUMENTS

| | | | | |
|---|---|---|---|---|
| 3,989,806 | A * | 11/1976 | Hyatt | 423/502 |
| 5,276,250 | A * | 1/1994 | Hagenmaier et al. | 588/316 |
| 6,303,812 | B1 * | 10/2001 | Fifolt et al. | 560/103 |
| 2002/0156337 | A1 * | 10/2002 | Jensen et al. | 588/206 |

FOREIGN PATENT DOCUMENTS

| | | | |
|---|---|---|---|
| EP | 1048327 | * | 3/2000 |

* cited by examiner

*Primary Examiner*—Stanley Silverman
*Assistant Examiner*—James Fiorito
(74) *Attorney, Agent, or Firm*—Notaro, Michalos & Zaccaria P.C.

(57) ABSTRACT

A method for dehalogenation detoxication of halogenated aromatic and/or cyclic compounds, based on the fact that at least one halogenated aromatic and/or cyclic compound is heated on a support matrix in a closed system at a temperature of 200 to 500° C. in the presence of copper in metallic form and/or in the form of copper compounds, a hydrogen donor, carbon and at least one additional reducing substance, capable of reducing cupric and cuprous ions to elemental copper at the above temperature.

2 Claims, No Drawings

METHOD FOR DEHALOGENATION DETOXICATION OF HALOGENATED AROMATIC AND/OR CYCLIC COMPOUNDS

TECHNICAL FIELD OF THE INVENTION

The invention is concerned with dehalogenation detoxication of halogenated aromatic and/or cyclic compounds. This method is particularly useful for detoxication of polyhalogenated aromatic compounds, especially highly toxic polychlorinated biphenyls, dibenzo-p-dioxins and dibenzofurans, as well as compounds similar to dioxins, in soils, carbonaceous sorbents, oils and sandy sediments.

BACKGROUND OF THE INVENTION

Some of the most persistent contaminating substances consist in polychlorinated dibenzo-p-dioxins, dibenzofurans and dioxin-like compounds. These are chemically stable substances that are very difficult to remove from the environment by chemical, thermal and biological procedures. These compounds are toxic and are classified amongst teratogenic and carcinogenic substances. They are formed in thermal processes, e.g. in the combustion of municipal, hospital and other hazardous wastes, in metallurgical processes and in the use of a number of other thermal technologies, or are manufactured for applications in the energy industry, agriculture and other branches.

Of the techniques employed to date for the destruction of these toxic substances, especially the reaction of these compounds with sodium of alkali metal alkoxides, as described in EP 1 153 645, is employed. Chemical decomposition, described in EP-A-0 021 294, is based on the reaction of halogenated aromatic substances with an alkali metal or with a mixture of alcohol with an alkali metal hydroxide, or with an alkali metal carbonate at a temperature of 140 to 220° C. Alkaline decomposition of polychlorinated biphenyls by sodium carbonate occurs at a temperature of 370 to 400° C. in the presence of an oxidizing agent and catalyst consisting in ruthenium or platinum or palladium, as described in JP 11 253 795, U.S. Pat. No. 4,059,677, U.S. Pat. No. 4,065,543 and JP 10 087 519. According to U.S. Pat. No. 5,151,401, platinum on zinc aluminate can also be used. JP 11 114 538 describes the pressure decomposition of polychlorinated biphenyls and polyfluorinated dibenzo-p-dioxins by calcium hydroxide at a temperature of 100 to 300° C. Patent documents WO 00/48968 and JP 11 197 756 describe the catalytic reduction of polyfluorinated dibenzo-p-dioxins in alkaline medium in the presence of hydrazine thiosulphate, hydroquinone and titanium dioxide on a carbon support matrix, or in a medium of zinc hydroxide and carbonate or lead hydroxide and carbonate, occurring at a temperature of 200 to 500° C.

Thermal decomposition of halogenated aromatic compounds requires that a temperature of 1200 to 1400° C. be attained. However, this decomposition process is of uncertain significance, because considerations related to practical applications do not take into account reversible processes occurring in the gas phase and designated as denovo synthetic reactions, in which the pollutants are reformed from the precursors in the temperature range 180 to 450° C. on the solid phase.

It is advantageous if some metals are present in the thermal detoxication of halogenated aromatic compounds, for example, aluminium, iron and copper, or their oxides, or melted aluminium or aluminium, magnesium, silicon, titanium or beryllium in an inert atmosphere at a temperature of 450 to 650° C., as is apparent from patent documents JP 11 253 908, EP 0 170 714 and EP 0 184 342. U.S. Pat. No. 3,697,608 describes the use of a dechlorination agent consisting of ferrous chloride or ferric chloride with alkali metal chlorides in the melt.

Catalytic decomposition of halogenated aromatic substances is considered to be very promising for practical applications in liquidation of these toxic substances. Nonetheless, the above-described decomposition processes do not constitute an optimal approach for dehalogenation detoxication of halogenated aromatic compounds, as these chemical processes are expensive, dangerous in the case of use of the sodium method and, for the combustion method, have high energy consumption and are not efficient because of the denovo synthetic reverse reactions.

EP-A-0 184 342 describes the use of metal catalysts to decompose organic halogenated compounds, e.g. polychlorinated biphenyls, in the gas phase at a temperature of 450 to 650° C. in a strictly nonoxidizing very pure nitrogen or rare gas atmosphere. Patent document JP 11 904 460 describes the use of metal hydride and palladium on a carbon matrix for detoxication of organic halogenated aromatic compounds. U.S. Pat. No. 4,039,623 describes the oxidation catalytic decomposition of halogenated compounds at a temperature of 350° C. catalyzed by ruthenium. According to Organohalogen Compounds 40, 583-590 (1999), polychlorinated biphenyls can be decomposed at a temperature of 150 to 300° C. using the $TiO_2$—$V_2O_5$—$WO_3$ catalytic system. Patent documents U.S. Pat. Nos. 3,972,979 and 3,989,806 describe the catalytic dehalogenation of hexachlorobenzene at a temperature of 500° C. using a catalyst consisting of copper on zeolite or chromium (III) oxide on a support. EP 0 914 877 and U.S. Pat. No. 6,291,737 describe the decomposition of dioxins in the presence of amines or ammonium salts at a temperature below 300° C. Patents U.S. Pat. Nos. 5,276,250 and 5,387,734 describe the dehalogenation of compounds in an inert atmosphere using catalysts containing calcium, barium, zinc, nickel, copper, iron, aluminium, palladium, platinum, vanadium, tungsten, molybdenum, rhodium and chromium, sometimes in the form of oxides, silicates or aluminates, with a mass ratio of the catalyst to the dehalogenated substance of 1:1 to 1:30 and at a temperature of 150 to 550° C. The article by Pekárek V. et al., ESPR-Environ. Sci. and Pollut. Res. 10(1), 39-43 (2003) describes a system for dehalogenation of ash from incineration of municipal waste using a combination of copper and carbon.

All the above dehalogenation procedures have the disadvantage that they have high energy demands and/or do not lead to complete detoxication of the dehalogenated material and/or do not constitute a closed, risk-free waste-free cycle.

SUMMARY OF THE INVENTION

The above disadvantages are eliminated to a substantial degree by the method of dehalogenation detoxication of halogenated aromatic and/or cyclic compounds according to the invention, which is based on a method where at least one halogenated aromatic and/or cyclic compound is heated on a support matrix in a closed system to a temperature of 200 to 500° C. in the presence of copper in metallic form and/or in the form of a compound of copper, a hydrogen donor, carbon and at least one additional reducing substance that is capable of reducing copper (II) and copper (I) ions at these temperatures to elemental copper.

It is advantageous if at least one of the additional reducing substances consists in a compound of copper with the character of a reducing substance.

It is advantageous if the support matrix is the material contaminated by the halogenated aromatic and/or cyclic substance intended for dehalogenation detoxication.

In this context, the term "closed system" means a reaction space in which the reaction components of the dehalogenation process are present under an air atmosphere prior to commencement of the dehalogenation detoxication process that, following closing, prevents access of oxygen from the surrounding atmosphere into the reaction space.

It is apparent from Pekárek V. et al., ESPR-Environ. Sci. and Pollut. Res. 10(1), 39-43 (2003) that, in the dehalogenation process, the detoxicated dehalogenated products and highly toxic substances formed by denovo synthesis constitute two types of final products of a single reaction and that the formation of detoxicated dehalogenated products and the formation of highly toxic substances by denovo synthesis are mutually competitive, where the progress of this single reaction in the forward or reverse direction depends on the choice of the reaction conditions. In an oxidizing oxygen atmosphere, denovo synthesis occurs predominantly, while the dehalogenation reaction predominates in an oxygen-free inert atmosphere. The approach according to the invention is based on finding conditions under which only the dehalogenation reaction occurs.

In the dehalogenation system, carbon primarily removes oxygen from the reaction system after it is closed and, in some cases, also mediates in provision of a sufficient amount of hydrogen donor as, under normal conditions, especially organic substances and water are adsorbed on carbon. It has been demonstrated that carbon with destroyed crystal structure is vaporized with formation of carbon monoxide and carbon dioxide in the presence of catalytically active copper at a temperature as low as 200° C. and thus forms a reducing or inert gas atmosphere. The reducing ability of carbon monoxide is, however, limited as this compound, which is an intermediate in the formation of carbon dioxide, is basically in the gas phase and its amount is limited by the amount of oxygen in the closed dehalogenation system. It has also been found that carbon by itself is not capable of ensuring a satisfactory course of the dehalogenation process. In specific cases, where neither carbon nor the other components of the dehalogenation process are capable of providing a sufficient amount of hydrogen donor, it is necessary to add a hydrogen donor as such to the system, e.g. in the form of water or paraffin oil. If a concentrated halogenated aromatic and/or cyclic substance is to be dehalogenated-detoxicated, i.e. a substance not present on a contaminated matrix, then this matrix must be added to the dehalogenation system. In this case, it is advantageous to employ a matrix that contains carbon in its structure or has the character of a hydrogen donor and that is not sintered during the dehalogenation process. Examples of such a matrix include active coke, feldspars, hydrated silicates and detoxicated ashes. Detoxicated ashes from waste incineration are very suitable matrices, as the structures of most of these ashes contains not only carbon and hydrogen donors, but also copper in a very active form for the dehalogenation process. It is known that heating of ashes from electrofilters or from sleeve filters, containing, e.g., dibenzo-p-dioxins, dibenzofurans and biphenyls, to a temperature of about 300° C., leads to a certain level of detoxication of these ashes. It is much harder to detoxicate ashes with a low content of unburned carbon and very low copper contents and the residual toxicity is high even following detoxication. In some cases, these ashes are even more toxic after detoxication than before this process as, for example, highly chlorinated dibenzo-p-dioxins and dibenzofurans are dechlorinated to much more toxic tetrachloro-p-dioxins and tetrachlorodibenzofurans, while detoxication does not occur at all for a great many types of ash because of the absence of the necessary reaction components for the dehalogenation process.

It is necessary to add copper or cuprous or cupric compounds when the matrix does not contain copper and its compounds in sufficient amounts for the successful progress of the dehalogenation process. Active forms of copper are preferable for the dehalogenation process. In the examples listed below, some copper compounds are employed in a nonrestrictive manner; these compounds were found to be especially suitable for the progress of the dehalogenation process. Very good results were also obtained using the cupric salts of organic acids.

The use of at least one additional reducing substance in addition to carbon, which is capable of reducing cuprous and cupric ions to elemental copper at the temperature of the dehalogenation process, constitutes the substance of the invention as, in this case, the reversible process $Cu \rightarrow Cu^{1+} \rightarrow Cu^{2+}$ and back occurs, in which the nascent form of copper is formed repeatedly and enables the successful course of the dehalogenation process according to the invention. The ability of this nascent form of copper to form an intermediate complex of the compound on the aromatic ring is so high that dehalogenation also occurs in positions that are thermodynamically very stable, so that, under optimised conditions, a degree of dehalogenation of up to 99.9% is attained even for highly stable halogenated aromatic and/or cyclic compounds.

In the following part of the description, the invention will be elucidated in more detail using specific examples of its implementation, where these examples are only illustrative in character and in no way limit the extent of the invention, which is delimited by the definition of patent rights and the content of the descriptive part.

EXAMPLES

Example 1

In the framework of this example, a study is made of the dependence of dehalogenation detoxication on the temperature. To a matrix of 960 g of silica gel, which was contaminated with 40 g of hexachlorobenzene, were added 45 g of cupric oxide, 100 g of active carbon and 100 g of formic acid acting as an additional reducing agent. The system was closed against atmospheric oxygen and heated for 4 hours at a temperature of 260 and 300° C. (Examples 1a and 1b, resp.). The experimental conditions were not optimized. The results obtained are depicted in the following Table 1.

TABLE 1

| T ° C. | $C_6H_6$ % | MCB % | DiCB % | TriCB % | TeCB % | PeCB % | HCB % |
|---|---|---|---|---|---|---|---|
| 260 (1a) | 79 | 21 | — | — | — | — | — |
| 300 (1b) | 100 | — | — | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

To a matrix of 960 g of feldspar, which was contaminated with 40 g of hexachlorobenzene, was added 45 g cupric oxide, 100 g active carbon and 45 g citric acid as an additional reducing agent. The system was closed against atmospheric oxygen and heated for 4 hours at a temperature of 200, 250, 300 and 350° C. (examples 1c, 1d, 1e and 1f, resp.). The experimental conditions were not optimized. The results obtained are depicted in the following Table 2.

TABLE 2

| T ° C. | $C_6H_6$ % | MCB % | DiCB % | TriCB % | TeCB % | PeCB % | HCB % |
|---|---|---|---|---|---|---|---|
| 200 (1c) | 0.5 | 0.2 | 8.9 | 59.7 | 30.7 | — | — |
| 250 (1d) | 9.1 | 54.5 | 35.9 | 0.5 | — | — | — |
| 300 (1e) | 93.1 | 6.9 | — | — | — | — | — |
| 350 (1f) | 100 | | | | | | |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

It follows from the results of the dependence of the dehalogenation process on temperature that the degree of dehalogenation is highly dependent on the chemical composition of the system and the stability of the dehalogenated compounds. In some cases, a relatively small temperature difference (40° C.) substantially affects the results of the dehalogenation while, in other cases, the reaction proceeds successfully only at higher temperatures.

Example 2

In this example, the dehalogenation of hexachlorobenzene is compared in the absence and presence of an additional reducing substance. To a matrix of 960 g of feldspar, which was contaminated with 40 g hexachlorobenzene was added 60 g of cupric hydroxide and 100 g of active coke (Litvínov). Dehalogenation was carried out without additional reducing substance (example 2a) and in the presence of 64 g formaldehyde as an additional reducing agent (example 2b). The system was closed against atmospheric oxygen and heated for 4 hours at a temperature of 300° C. The experimental conditions were not optimized. The results obtained are depicted in the following Table 3.

TABLE 3

| T ° C. | $C_6H_6$ % | MCB % | DiCB % | TriCB % | TeCB % | PeCB % | HCB % |
|---|---|---|---|---|---|---|---|
| 2a | — | — | 4.6 | 82.6 | 12.8 | — | — |
| 2b | 99.3 | 0.7 | — | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

To a matrix of 960 g of silica gel, which was contaminated with 40 g of hexachlorobenzene, were added 45 g of cupric oxide and 100 g of active carbon. Dehalogenation was carried out without additional reducing agent (example 2c) and in the presence of 45 g of citric acid as an additional reducing agent. The system was closed against atmospheric oxygen and heated for 4 hours at a temperature of 260° C. The experimental conditions were not optimized. The results obtained are depicted in the following Table 4.

TABLE 4

| T ° C. | $C_6H_6$ % | MCB % | DiCB % | TriCB % | TeCB % | PeCB % | HCB % |
|---|---|---|---|---|---|---|---|
| 2c | — | — | — | 7.4 | 72.5 | 20.1 | — |
| 2d | 12.1 | 55.6 | 32.3 | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

The above results indicate that the presence of a carbon reducing agent alone is not sufficient for complete dehalogenation and that complete dehalogenation occurs only in the presence of an additional reducing agent.

To a matrix of 960 g of feldspar, which was contaminated with 40 g hexachlorobenzene was added 42 g of cupric hydroxide and 100 g of active carbon. Dehalogenation was carried out without addition of an additional reducing substance (example 2e) and in the presence of 64 g formaldehyde as an additional reducing agent (example 2f). The system was closed against atmospheric oxygen and heated for 3 hours at a temperature of 300° C. The experimental conditions were not optimized. The results obtained are depicted in the following Table 5.

TABLE 5

| T ° C. | $C_6H_6$ % | MCB % | DiCB % | TriCB % | TeCB % | PeCB % | HCB % |
|---|---|---|---|---|---|---|---|
| 2e | 1.5 | 33 | 64.1 | 1.4 | — | — | — |
| 2f | 100 | — | — | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

The above results also indicate that the presence of an additional reducing agent in the given system is essential for successful progress of the dehalogenation process.

Example 3

In this example, decachlorobiphenyl is dehalogenated. To a matrix of 960 g of Silcal product (silicate matrix), which was contaminated with 40 g of decachlorobiphenyl, was added 42 g of cuprous oxide, 100 g of active carbon and 15 g of citric acid as an additional reducing agent. The system was closed against atmospheric oxygen and heated for 4 hours at a temperature of 280° C. The conditions of the dehalogenation process were not optimized. Following dehalogenation, the system contained 99% biphenyl, 0.2% 2,2',6,6'-tetrachlorobiphenyl, 0.3% 2,2',6,-trichlorobiphenyl and 0.5% di- and monochlorobiphenyls. The results obtained indicate that the dehalogenation efficiency of the system according to the invention is high even when conditions are not optimized, as, even with a lower amount of additional reducing agent and at a temperature of 280° C., 99% of the ten chlorine atoms in the decachlorobiphenyl molecules were dehalogenated.

Example 4

In this example, a study was made of the dependence of dehalogenation on time. To a matrix of 960 g of extracted ash from a municipal waste incinerator, which was contaminated with 40 g of hezachlorobenzene, was added 45 g of cupric oxide, 100 g of active carbon and 45 g of tartaric acid as an additional reducing agent. The system was closed against atmospheric oxygen and heated at a temperature of 300° C. for 1, 2 and 3 ours (examples 4a, 4b and 4c, resp.). The experimental conditions were not optimized. The results obtained are depicted in the following Table 6.

TABLE 6

| t (h) | $C_6H_6$ % | MCB % | DiCB % | TriCB % | TeCB % | PeCB % | HCB % |
|---|---|---|---|---|---|---|---|
| 1 (4a) | 95.2 | 4.8 | — | — | — | — | — |
| 2 (4b) | 99.9 | 0.1 | — | — | — | — | — |
| 3 (4c) | 99.99 | 0.01 | — | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

To a matrix of 960 g of feldspar, which was contaminated with 40 g hexachlorobenzene, was added 45 g of cupric hydroxide, 100 g of active coke (Ostrava) and 45 g of citric acid as an additional reducing substance. The system was closed against atmospheric oxygen and heated at a temperature of 300° C. for 1, 2, 3 and 4 hours (examples 4d, 4e, 4f and 4g, resp.). The experimental conditions were not optimized. The results obtained are depicted in the following Table 7.

TABLE 7

| t (h) | $C_6H_6$ % | MCB % | DiCB % | TriCB % | TeCB % | PeCB % | HCB % |
|---|---|---|---|---|---|---|---|
| 1 (4d) | 26.3 | 64.8 | 8.9 | — | — | — | — |
| 2 (4e) | 48.8 | 50.2 | 1 | — | — | — | — |
| 3 (4f) | 69.2 | 30.7 | 0.1 | — | — | — | — |
| 4 (4g) | 93.1 | 6.9 | — | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

The above results indicate that the dehalogenation time significantly affects the level of dehalogenation, where the degree of this effect can differ considerably amongst the individual dehalogenated substances because of the different chemical stability of the individual dehalogenated compounds and the selected composition of the reaction components in the dehalogenation system.

Example 5

In the framework of this example, a study was made of the dependence of the course of the dehalogenation on the character of the matrix. To 960 g of various types of matrices, which were contaminated with 40 g hexachlorobenzene, was added 45 g of cupric oxide, 100 g of active carbon and 45 g of citric acid as an additional reducing substance. The system was closed against atmospheric oxygen and heated for 4 hours at a temperature of 300° C. In the framework of this study, the following types of matrix were employed: A—feldspar, B—extracted ash from a municipal waste incinerator and C—silica gel. The experimental conditions were not optimized. The results obtained are depicted in the following Table 8.

TABLE 8

| matrix | $C_6H_6$ % | MCB % | DiCB % | TriCB % | TeCB % | PeCB % | HCB % |
|---|---|---|---|---|---|---|---|
| A - feldspar | 93.1 | 6.9 | — | — | — | — | — |
| B - ash | 100 | — | — | — | — | — | — |
| C - silica gel | 99.2 | 0.8 | — | — | — | — | — |

$C_6H_6$—benzene,
MCB—monochlorobenzene,
DiCB—dichlorobenzene,
TriCB—trichlorobenzene,
TeCB—tetrachlorobenzene,
PeCB—pentachlorobenzene,
HCB—hexachlorobenzene.

The results obtained for the individual types of matrix indicate that the character of the matrix has a relatively small effect on the progress of the dehalogenation process. It also follows from the results that extracted ash or ash after the dehalogenation process can readily be used for further dehalogenation processes. It is also apparent that the dehalogenation process can be successfully carried out on less suitable matrices when the conditions under which this process is carried out are suitably optimized.

Example 6

Polychlorinated biphenyls were dehalogenated in this example. To a matrix of 20 kg of dehalogenated ash from a municipal waste incinerator, which was contaminated with 1.2 kg of the product Delor 103 (polychlorinated biphenyl, containing trichlorobiphenyl as the main component) was added 1 kg of cupric oxide, 2 kg of Ostrava active coke and 1 kg of citric acid as an additional reducing agent. The system was closed against atmospheric oxygen and heated for 4 hours at a temperature of 300° C. The experimental conditions were optimized. The results of dehalogenation detoxication of the ash are depicted in the following Table 9.

TABLE 9

| | I-TEF | [ng PCB/g] | [ng TEQ PCB/g] BLOD = 0 |
|---|---|---|---|
| PCB81 | 0.0001 | 0.56 | 0.000056 |
| PCB77 | 0.0001 | 23.4 | 0.00234 |
| PCB126 | 0.1 | <0.06 | BLOD |
| PCB169 | 0.01 | <0.11 | BLOD |
| PCB123 | 0.0001 | 0.29 | 0.000029 |
| PCB118 | 0.0001 | 9.28 | 0.000928 |
| PCB114 | 0.0005 | 0.05 | 0.000025 |
| PCB105 | 0.0001 | 3.32 | 0.000332 |
| PCB167 | 0.00001 | <0.08 | BLOD |
| PCB156 | 0.0005 | <0.07 | BLOD |
| PCB157 | 0.0005 | <0.06 | BLOD |
| PCB189 | 0.0001 | <0.11 | BLOD |
| Sum of PCB | | 37 | 0.0037 |

Numbering of toxic polychlorinated biphenyls (PCB) according to Ballschmiter is used; I-TEF means the toxic equivalent for recalculation of concentration units (ng PCB/g) to concentration units including toxicity (ng TEQ PCB/g); BLOD=below the limit of determination.

It is apparent from the results obtained that polychlorinated biphenyls of the Delor type were 100% dehalogenated-detoxicated.

Example 7

In the framework of this example, dehalogenation detoxication was carried out on polychlorinated dibenzo-p-dioxins and dibenzofurans in ash from hazardous waste incinerators. To 20 kg of ash from sleeve filters of a hazardous waste incinerator, contaminated, amongst other things, with polychlorinated dibenzo-p-dioxins (PCDD) and dibenzofurans (PCDF), were added 2 kg of Ostrava active coke, 1 kg of cupric oxide and 1 kg of citric acid as an additional reducing agent. The system was closed against atmospheric oxygen and heated for 4 hours at a temperature of 300° C. The experimental conditions were optimized. The results of this dehalogenation detoxication of the ash are depicted in the following Table 10.

TABLE 10

| | I-TEF | A ng | B PCDD/g | A ng PCDD/F TEQ/g (BLOD = 0) | B |
|---|---|---|---|---|---|
| 2378TCDD | 1 | 1.30 | <0.0060 | 1.3 | BLOD |
| 12378PeCDD | 1 | 7.97 | <0.0060 | 7.97 | BLOD |
| 123478HxCDD | 0.1 | 15.7 | <0.0080 | 1.57 | BLOD |
| 123678HxCDD | 0.1 | 27.3 | <0.0080 | 2.73 | BLOD |
| 123789HxCDD | 0.1 | 21.5 | <0.0090 | 2.15 | BLOD |
| 1234678HpCDD | 0.01 | 307 | 0.0102 | 3.07 | 0.000102 |
| OCDD | 0.0001 | 960 | 0.0475 | 0.096 | 0.00000475 |
| TCDD | | 32.3 | 0.0371 | | |
| PeCDD | | 92.2 | <0.032 | | |
| HxCDD | | 419 | <0.042 | | |
| HpCDD | | 573 | <0.018 | | |
| Sum of PCDD | | 2076 | 0.0846 | 18.9 | 0.000107 |
| 2378TCDF | 0.1 | 9.14 | <0.006 | 0.914 | BLOD |
| 12378PeCDF | 0.05 | 18.8 | 0.0034 | 0.94 | 0.00017 |
| 23478PeCDF | 0.5 | 35.4 | 0.011 | 17.7 | 0.0055 |
| 123478HxCDF | 0.1 | 67 | 0.0079 | 6.7 | 0.00079 |
| 123678HxCDF | 0.1 | 74.6 | 0.0051 | 7.46 | 0.00051 |
| 234678HxCDF | 0.1 | 200 | 0.0085 | 20 | 0.00085 |
| 123789HxCDF | 0.1 | 7.88 | <0.005 | 0.788 | BLOD |
| 1234678HpCDF | 0.01 | 536 | 0.0245 | 5.36 | 0.000245 |
| 1234789HpCDF | 0.01 | 112 | <0.006 | 1.12 | BLOD |
| OCDF | 0.0001 | 5640 | 0.0676 | 0.564 | 0.00000676 |

TABLE 10-continued

| | I-TEF | A ng | B PCDD/g | A ng PCDD/F TEQ/g (BLOD = 0) | B |
|---|---|---|---|---|---|
| TCDF | | 238 | 0.177 | | |
| PeCDF | | 423 | 0.0869 | | |
| HxCDF | | 881 | 0.0843 | | |
| HpCDF | | 1050 | 0.0431 | | |
| Sum of PCDF | | 8232 | 0.459 | 61.5 | 0.00807 |
| Sum of PCDD/F | | 10308 | 0.54 | 80 | 0.0082 |

A—contamination of the ash prior to dehalogenation detoxication;
B—residual contamination after dehalogenation detoxication;
I-TEF, TEQ and BLOD—see the legend to Table 9;
DD—dibenzo-p-dioxin;
DF—dibenzofuran;
TC—tetrachloro;
Pe—pentachloro;
Hx—hexachloro;
Hp—heptachloro;
OC—octachloro.

It is apparent from the above results that polychlorinated dibenzo-p-dioxins were 99.996% dehalogenated and 99.9994% detoxicated and that polychlorinated dibenzofurans were 99.995% dehalogenated and 99.99% detoxicated. It unambiguously follows from these results that dehalogenation detoxication according to the invention can be used to effectively decompose very stable and the most toxic compounds of persistent organic contaminants.

The invention claimed is:

1. A method for speedy and substantially complete dehalogenation detoxification of a halogenated aromatic or a halogenated cyclic compound, comprising:

heating said compound on a support matrix in a closed system at a temperature of 250 to 500° C. in the presence of:

(a) a copper compound, (b) a hydrogen donor, (c) carbon, and (d) at least one organic additional reducing substance capable of reducing cupric and cuprous ions to elemental copper in nascent form at said temperature.

2. The method according to claim 1, wherein said support matrix is a material contaminated by the at least one halogenated aromatic and cyclic compound intended for dehalogenation detoxification.

* * * * *